United States Patent [19]

Groves

[11] Patent Number: 4,765,617

[45] Date of Patent: Aug. 23, 1988

[54] PORTABLE SEAT FOR BASEBALL CATCHERS POSITIONED BEHIND HOME PLATE

[76] Inventor: Keith N. Groves, 3200 McLeod Dr., Apt. 210, Las Vegas, Nev. 89121

[21] Appl. No.: 28,791

[22] Filed: Mar. 23, 1987

Related U.S. Application Data

[63] Continuation-in-part of Ser. No. 817,585, Jan. 10, 1986, abandoned.

[51] Int. Cl.[4] ..... A63B 71/00

[52] U.S. Cl. ..... 273/25; 272/52; 297/209

[58] Field of Search ..... 272/52, 53.1, 52.5; 273/25; 297/4, 195, 196, 208, 209, 210, 160; 248/624

[56] References Cited

U.S. PATENT DOCUMENTS

| | | | |
|---|---|---|---|
| 572,544 | 12/1896 | Hipperling | 297/195 |
| 606,314 | 6/1898 | Thomas | 297/209 |
| 759,809 | 5/1904 | Farley | 297/4 |
| 3,119,626 | 1/1964 | Strader | 248/624 |
| 3,417,990 | 12/1968 | Marasco | 272/52.5 |
| 4,379,550 | 4/1983 | Petersen | 272/52 |

FOREIGN PATENT DOCUMENTS

| | | | |
|---|---|---|---|
| 2422865 | 3/1976 | Fed. Rep. of Germany | 272/52 |
| 948932 | 8/1949 | France | 297/195 |
| 333413 | 8/1930 | United Kingdom | 297/195 |

*Primary Examiner*—Anton O. Oechsle
*Assistant Examiner*—T. Brown

[57] ABSTRACT

A portable seat for catchers positioned behind home plate which lessens the strain on the knees and legs of the catcher and thereby helps the catcher maintain top performance and extends his life as a catcher, the seat comprising a base plate adapted to being placed on a level surface, a vertically extending heavy duty coil spring having the bottom end thereof fixedly attached to the top of the base and the upper end removable attached to the bottom of a horizontally placed seat, the seat preferably being of the bicycle type narrowing in the front for the catcher's leg and having springs underneath to permit bending to the side and providing a comfortable position for the catcher.

3 Claims, 1 Drawing Sheet

PORTABLE SEAT FOR BASEBALL CATCHERS POSITIONED BEHIND HOME PLATE

BACKGROUND OF THE INVENTION

This application is a continuation-in-part of my application Ser. No. 817,585, filed Jan. 10, 1986 now abandoned.

1. Field of the Invention

This invention relates to a new device for use in the game of baseball or softball. More particularly, the invention relates to a new type of portable seat for use by catchers positioned behind home plate.

Specifically, the invention provides a new and highly efficient portable seat for use by catchers behind home plate during batting practice or bull pen training of pitchers which lessens the strain on the knees and legs of the catcher and thereby helps the catcher maintain top performance during the game and extends his life as a catcher. The new portable seat broadly comprises in combination a base plate adapted to being placed on a level surface, such as the ground, a vertically extending heavy duty coil spring having the bottom end thereof fixedly attached to the top of said base plate and the upper end removable attached to the bottom of a horizontally placed seat, said seat preferably being of a bicycle type narrowing in the front to provide space for movement of the legs and equipped with spring means underneath to permit bending to either side and a more comfortable position for the catcher, said seat also preferalby being provided on the front side with a small vertically extending protector to avoid injury to the catcher's groin area.

2. Prior Art

In a conventional baseball practice or training of pitchers the catcher crouches down behind home plate to await the pitch from the pitcher on the mound. The catcher generally holds his glove within the strike zone for the benefit of the pitcher, and this requires him to crouch quite low with the bulk of his weight being placed on his bent legs, knees and feet. To remain in this position for sometime places a considerable strain on his body and tires him out after several innings of play. As a result, considerable time is needed between games for the catcher to rest, and his overall lifespan as a catcher is often greatly reduced.

In addition, while the catcher generally always wears a protective shield to protect his upper body, when he is in the crouch position a low ball or a ball bouncing near the plate could pas under the regular protective shield and cause damage to the groin area of the catcher's body.

Furthermore, while the catcher is in the crouched position, it is difficult for him to lean to either side to quickly catch a ball thrown out of the strike zone, and in some cases injury results from falling to the side to catch such a ball.

It is an object of the invention, therefore, to provide a new type of portable catcher's seat for use behind the plate. It is a further object to provide a new portable seat for use by catchers behind the plates which eliminates the strain on the legs, knees and feet of the catcher. It is a further object to provide a portable seat for catchers behind home plate which eliminates strain and permits the catcher to be used more frequently during the baseball season. It is a further object to provide a device for use by the catacher which prolongs his life in the baseball world. It is a further object to provide a portable seat for the catcher behind home plate which gives him added protection for the groin area against bounced balls, etc. It is a further to provide a portable seat for catachers which permits the catcher to quickly extend himself to the right or left without danger of falling. These and other objects of the invention will be apparent from the following detailed description thereof.

SUMMARY OF THE INVENTION

It has now been discovered that these and other objects can be accomplished by the new portable seat for baseball catchers position behind home plate of the present invention which presents for the first time an efficient and highly effective way for the preserving the health and playing time of catchers in the field of baseball and softball.

The new portable seat for the catcher behind home plate broadly comprises in combination a base plate adapted to being placed on a level surface, such as the ground, a vertically extending heavy duty oil spring having the bottom end thereof fixedly attached to the top of said base plate and the upper end removably attached to the bottom of a seat, said seat preferably being of the bicycle type wherein the seat narrows at the front to permit easy movement of the bent legs and there are spring means under the seat to permit rapid movement from side to side, said seat also preferably being provided in the front side with a small vertically extending protector to cover the groin area but not large enough to interfer with the movement of the catacher in retrieving the thrown ball.

It has been found that the above-described portable seat surprisingly meets all of the objects noted above. When seated on the above-noted portable seat, the catcher is able to crouch to the desired position and hold the mit behind the strike zone, but at the same time be relieved of the strain on his legs, knees and feet as the weight of the body is now taken up by the seat. In addition, with the spring supported seat, the catcher is able to quickly bend to the right or left to catch balls thrown out of the strike zone, without any danger of falling as the seat bends with the weight but still retains the full weight of the body. Further advantage is found in the fact that with the special protector on the front of the seat, the groin area of the catcher is full protected from the low pitched balls or the balls bouncing up from the plate area.

The seat, of course, is also portable and light weight so that it can be easily carried and stored for the next game.

DESCRIPTION OF THE DRAWING

The various objects and features of the present invention will be more fully understood by reference to the accompanying drawing.

DESCRIPTION OF THE PRODUCT OF THE INVENTION

Figure 1:
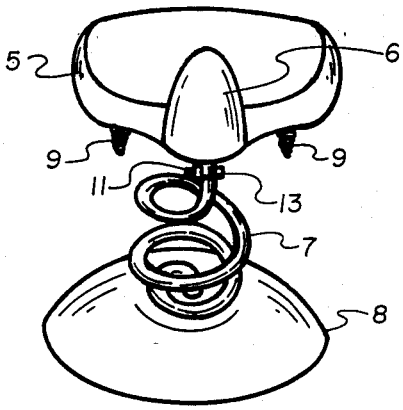
FIG. 1 is a perspective view of the seat as assembled with the protector.

With reference to FIG. 1 of the drawing which is a perspective view of the seat as assembled, the base 8 is attached to the coiled spring 7 which is attached at the terminal end to seat 5 by means of lock means 11 and bolt 13. The seat is provided with springs 9 and protector 6.

Figure 2:
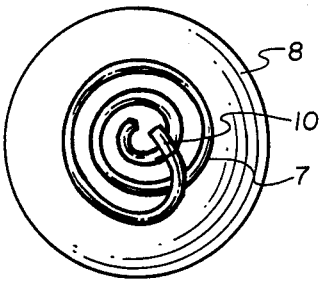
FIG. 2 is a top view of the base with attached spring.

With reference to FIG. 2 which is a top view of the base and spring, base is shown as 8, with coil spring 7 terminating with split pipe 10 which receives male element 15 which in turn is locked therein by lock clamp 11 and bolt 13.

Figure 3:
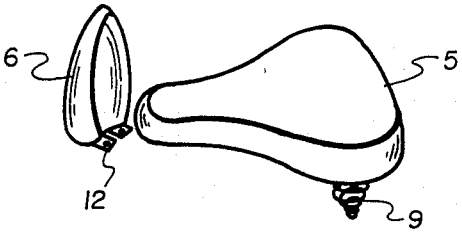
FIG. 3 is a side view of the seat by itself with the protector unattached.

With reference to FIG. 3 which shows the unattached seat, the seat 5 is shown with springs 9. Protector 6 is shown unattached with attachments 12 used to attach the protector to the bottom of the seat.

Figure 4:
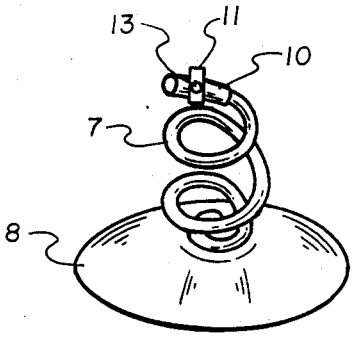
FIG. 4 is a front view of the base and attached coil spring without the seat.

With reference to FIG. 4 which is a front view of the base and spring, the base is shown as 8, the spring 7 and split pipe segment 10 containing lock means 11 with bolt 13.

Figure 5:
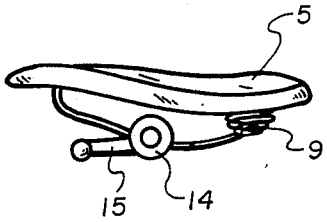
FIG. 5 is a side view of the seat showing the ball joint and springs.

FIG. 5 which is a side view of the seat shows the seat 5, spring 9, ball joint 14 and male element 15.

DETAILED DESCRIPTION OF THE INVENTION

While the above-described description of the invention and drawings have been made in rather specific terms, it should be understood that various changes can be made in construction and operation without departing from the scope of the present invention.

The base plate for the portable seat may be of the shape and size needed to provide a solid base for the seat without giving instability to the catcher as he functions behind the plate. In general, the plate is preferably substantially round and having a diameter from about 10 to 12 inches. The bottom of the plate is preferably concave so as to add stability to the seat while the catcher is functioning. Preferably the plate is made from about 16 guage sheet metal but can be made from other types of metal, wood or thick plastic as long as it provides the necessary stability for the seat. Particularly superior results are obtained when the plate is of iron or steel with a circular diameter of about 12 inches.

The coil spring attached to the top of the base plate is preferably heavy duty and strong enough to support the weight of the catcher. Preferably the coil spring is a steel spring prepared from steel rod having a diameter of about ⅜ inches to ½ inches and coiled in a circle having a diameter of about 4 to 6 inches. The coil spring should be high enough so as to provide the proper height for the catcher in the crouched position. The height of the seat form the top of the seat to the ground generally varies from about 11 to 13 inches, and still more preferably at about 12 inches. Considering the height of the seat and the base plate, this should make the height of the coil spring between 6 and 7 inches.

The coil spring is fixedly attached to the top center of the base plate in any desired fashion. In general, the bottom of the spring is welded to the top of the metal base plate so as to give seat the necessary stability, although other means may be employed as desired or necessary.

The top end of the coil spring preferably has a split pipe fitting placed over the end so that the male portion of the seat connector can be slipped into the fitting and tighten thereon. This provides a means for attaching the seat to the coil as well as providing a means for adjusting the seat backwards or forwards as needed.

The seat to be attached to the top of the coil spring may be of any suitable size or construction as long as it provides the proper seating capacity for the catcher. As noted, the seat is preferably of the bicycle type. In this case, the seat is narrower on the sides of the front to permit movement of the legs of the catcher, and is provided with under spring on the left and right side of the back of the seat so as to provide some resilience and ability to bend to the right or left side while still seated on the apparatus.

As shown in the drawing (FIG. 5), the springs on both sides of the back of the seat are attached to a frame which in turn is joined to a ball joint 14 containing male rod 15 which is fitted in the pipe fitting on the coil spring. The boil joint also on being loosened and tightened could be used to raise or lower the front of the seat as needed to fit the catcher's requirements.

As indicated a protector may be secured to the front of the seat to provide added protection for the groin area of the catcher that is not protected by the conventional vest worn by the baseball catcher. This protector which is of sufficient width to provide the protection for the front portion of the catcher's groin area, but not high enough to interfer with the movement of the catcher. In general, the protect preferably varies from about 2 to 3 inches high and about 4 to 6 inches in length.

The protector can be prepared from any suitable material, but is preferably prepared from strong thick plastic sheets or thick rubber sheets so as to provide protection but flexibility in the event the catcher is forced against the protector.

The protector is preferably removably attached to the front of the seat in the event the catcher works better without the protector. Preferably the protector is attached by braces which is bolted or screwed under the bottom of the front portion of the seat.

PREFERRED EMBODIMENT OF THE INVENTION

A preferred embodiment of the invention is described below. It should be understood, however, that this is given as a preferred assembly of apparatus for certain purposes and is not to be regarded as limiting the invention in any way.

A base plate was prepared from sheet metal of 16 guage steel having a circular diameter of 12 inches. The bottom was pressed in a depth of about 2 inches in concave shape so as to give better stability to the base.

A coil spring prepared from ½ inch iron rod coiled in a diameter of 4 inches with a height of about 6 inches. A piece of pipe fitting of about 1½ inches in diameter and about 3 inches in length was welded on one end of the coil spring so as to provide a female fitting for the seat. The bottom end of the coil spring was welded onto the top center of the above-described base plate.

A conventional bicycle seat having a male rod coming from the ball joint under the seat was attached to the coil spring by inserting of the male rod into the female fitting on the top of the coil spring and a clamp tightened onto the female fitting to hold the seat securely in place.

A protector comprising a ¼ inch thick sheet of polypropylene having a size of 3 inches by 5 inches was secured to the front of the seat so as to have the protector rising vertically in front of the seat for a distance of about 3 inches.

The new portable seat prepared as above was used in a practice session of hitting as well as bull pen session for training of pitchers. The catcher found that he was able to function in all regards while on the seat, and in addition was able to perform the whole practice session without strain on his knees, legs or feet, and was able to play again without the usual period of rest. The protector was of particular advantage to the catcher as he was protected from several bounced balls which might of injured his groin area.

I claim as my invention:

1. A portable seat for baseball catchers positioned behind home plate comprising in combination a base plate adapted to being placed on a substantially level surface but not attached thereto, a vertically extending coil spring having the bottom end thereof fixedly attached to the top of said base plate and the upper end removably attached to the bottom of a horizontally placed seat, said seat being of the bicycle type narrowing in front to provide space for movement of the catchers legs and equipped with spring means underneath to permit bending to either side, and said seat having a vertically extending protector attached to the front of the seat and of a side to side width significantly greater than its front to back dimension to provide protection to the groin area of the catcher as he sits on the seat but low enough to permit the catcher to catch a pitched ball thrown directly across the plate in the strike zone in front of the catcher while the catcher is in the crouched position on the seat, and said coil spring being of such a height and said seat being of such a size as to permit a baseball catcher to sit on the seat in a crouching position with his feet placed on the ground.

2. A portable seat for catchers as defined in claim 1 wherein the base plate is concave on the bottom side to provide better stability on the ground.

3. A portable seat for catchers as defined in claim 1 wherein the base plate has a diameter of 10 to 12 inches, and the seat is about 10 to 12 inches above the bottom of the plate.

* * * * *